US010570606B2

(12) United States Patent
Hoy

(10) Patent No.: US 10,570,606 B2
(45) Date of Patent: Feb. 25, 2020

(54) SUPPORT-FRAMEWORKS

(71) Applicant: Kevin Douglas Hoy, Buckinghamshire (GB)

(72) Inventor: Kevin Douglas Hoy, Buckinghamshire (GB)

( * ) Notice: Subject to any disclaimer, the term of this patent is extended or adjusted under 35 U.S.C. 154(b) by 0 days.

(21) Appl. No.: 16/093,735

(22) PCT Filed: Apr. 17, 2017

(86) PCT No.: PCT/EP2017/000483
§ 371 (c)(1),
(2) Date: Oct. 15, 2018

(87) PCT Pub. No.: WO2017/178116
PCT Pub. Date: Oct. 19, 2017

(65) Prior Publication Data

US 2019/0119899 A1 Apr. 25, 2019

(30) Foreign Application Priority Data

Apr. 15, 2016 (GB) ..... 1606672.2

(51) Int. Cl.
*A47B 95/00* (2006.01)
*E04B 1/19* (2006.01)
(Continued)

(52) U.S. Cl.
CPC ..... *E04B 1/1906* (2013.01); *E04F 13/0855* (2013.01); *E04F 13/0871* (2013.01);
(Continued)

(58) Field of Classification Search
CPC ..... B29C 65/561; E04B 1/19; E04B 1/1906; E04B 1/3211
See application file for complete search history.

(56) References Cited

U.S. PATENT DOCUMENTS 3,333,375 A * 8/1967 Johnston ..... E04B 1/3211 52/81.3
3,547,275 A * 12/1970 Engel ..... A47F 5/13 211/205

(Continued)

FOREIGN PATENT DOCUMENTS

CN 201433469 Y 3/2010
CN 201865202 U 6/2011
GB 2 256 444 A 12/1992

OTHER PUBLICATIONS

British Search Report Corresponding to GB1706055.9 dated Sep. 21, 2017.

(Continued)

*Primary Examiner* — Amy J. Sterling
(74) *Attorney, Agent, or Firm* — Davis & Bujold PLLC; Michael J. Bujold

(57) ABSTRACT

A support-framework (1) supports a surface (2), or supported elements, at a designed variable spacing from a support surface (3), using elongate supports (4) of rod-from or tubular-form that act as ties or struts. Each support (4) is anchored at one of its ends to the supported surface (2) or element and, at the other end, to the support surface (3). The anchoring at each end is via a node N that involves an individual domed-member (5) which is secured to the relevant surface (2, 3) or supported element, and which has a part-spherical surface (6) to which the elongate supports (4) are anchored to extend radially by a coupling (12). The domed-members (5) are metallic or plastics, and may each be hemispherical having an outwardly directed equatorial flange (7) by which they are secured to the relevant surface (2, 3) or supported element.

20 Claims, 5 Drawing Sheets

(51) Int. Cl.
*E04F 13/08* (2006.01)
*E04F 13/18* (2006.01)
*E04H 15/34* (2006.01)

(52) U.S. Cl.
CPC ..... *E04F 13/18* (2013.01); *E04H 15/34* (2013.01); *E04B 2001/196* (2013.01); *E04B 2001/1927* (2013.01)

(56) References Cited

U.S. PATENT DOCUMENTS 4,027,449 A * 6/1977 Alcalde Cilveti ..... E04B 1/19 52/655.2
4,562,682 A * 1/1986 Arvedi ..... E04B 1/19 403/171
4,624,090 A * 11/1986 Stienen ..... E04B 1/1906 403/172
4,648,223 A * 3/1987 Richard ..... E04B 1/19 403/171
5,421,666 A * 6/1995 Spears ..... B29C 65/561 403/169
5,556,219 A * 9/1996 Mason ..... E04B 1/1903 403/169
2005/0040312 A1 2/2005 Tsai

OTHER PUBLICATIONS

International Search Report Corresponding to PCT/EP2017/000483 dated Jul. 13, 2017.
Written Opinion Corresponding to PCT/EP2017/000483 dated Jul. 13, 2017.

* cited by examiner

SUPPORT-FRAMEWORKS

This invention relates to support-frameworks of a kind for affording support to a surface or one or more other elements using elongate supports which, in accordance with the relevant stress analysis, act individually as struts or ties anchored to the supported surface or one or more other elements.

Support-frameworks of the above kind are used, for example, in the support and construction of wall-cladding, roofs and ceilings to buildings or other permanent or temporary structures, and in the support of floors, platforms and staging. Such support is commonly achieved by anchoring elongate supports at one end to the surface or the one or more other elements to be supported, with the other ends anchored to one or more supporting structures, so as to establish a framework of the elongate supports between the supported surface or other element and the one or more supporting structures.

The number and relative spacings required of the anchoring locations on the supported surface or the one or more other elements, and on the one or more supporting structures, depends on the relative disposition, loading and individual configuration requirements of the supported surface or the one or more other elements concerned. One or more elongate supports are anchored at each anchoring location, and the anchoring within each such location establishes, in the terminology of the present application, a 'node' of the framework formed by the elongate supports extending between the supported surface or the one or more other elements, and the one or more supporting structures.

It is one of the objects of the present invention to facilitate the anchoring of the elongate supports at each node.

According to the present invention there is provided a support-framework for affording support of a supported surface or of one or more other supported elements, wherein an end of each of one or more elongate supports is anchored to the supported surface or to at least one of the supported elements via a node that involves an individual domed-member which is secured to the supported surface or relevant supported element, and which has a part-spherical surface to which the one or more elongate supports extend radially.

The supported surface or each of the one or more supported elements of the support-framework may be supported by a plurality of the elongate supports which have ends anchored via nodes in one or more supporting structures (for example, purlins or beams), each node of the framework on the one or more supporting structures comprising an individual domed-member that has a part-spherical surface from which the one or more elongate supports of the node extend radially. The support of the supported surface or supported element may be from a supporting surface, which may be a structural surface, as for example in the support of cladding or facing surfaces of internal or external walls of a building or other structure, and in these circumstances the framework may include nodes that involve respective domed-members which each have a part-spherical surface and which are secured to the relevant supporting surface at spaced locations from one another.

According to a feature of the present invention there is provided a support-framework located between two surfaces for providing mutual support between the two surfaces, or support of one of the surfaces from the other, wherein opposite ends of elongate supports are anchored in nodes of the framework secured to the two surfaces respectively, and the anchoring of the ends of the elongate supports to the respective surface at each such node is via a domed-member individual to the node secured to the respective surface with one or more of the elongate supports anchored to a part-spherical surface of the domed-member to extend radially from that part-spherical surface.

A particular advantage of the present invention lies in the facility and economy with which the support-framework can be designed and constructed even where there is complexity of configuration or otherwise in the supported surface or other element and/or in the supporting surface or other supporting structure or structures.

The domed-member at each node referred to above, may be hollow and have a circumferential outwardly-directed flange for use in securing the domed-member to the relevant surface or supporting structure. The domed-members may be of metal, for example pressed sheet metal, or of plastics.

The elongate supports may be rods or hollow tubes, and for example, may be metal extrusions.

Support-frameworks according to the present invention will now be described, by way of example, with reference to the accompanying drawings, in which.

Figure 1:
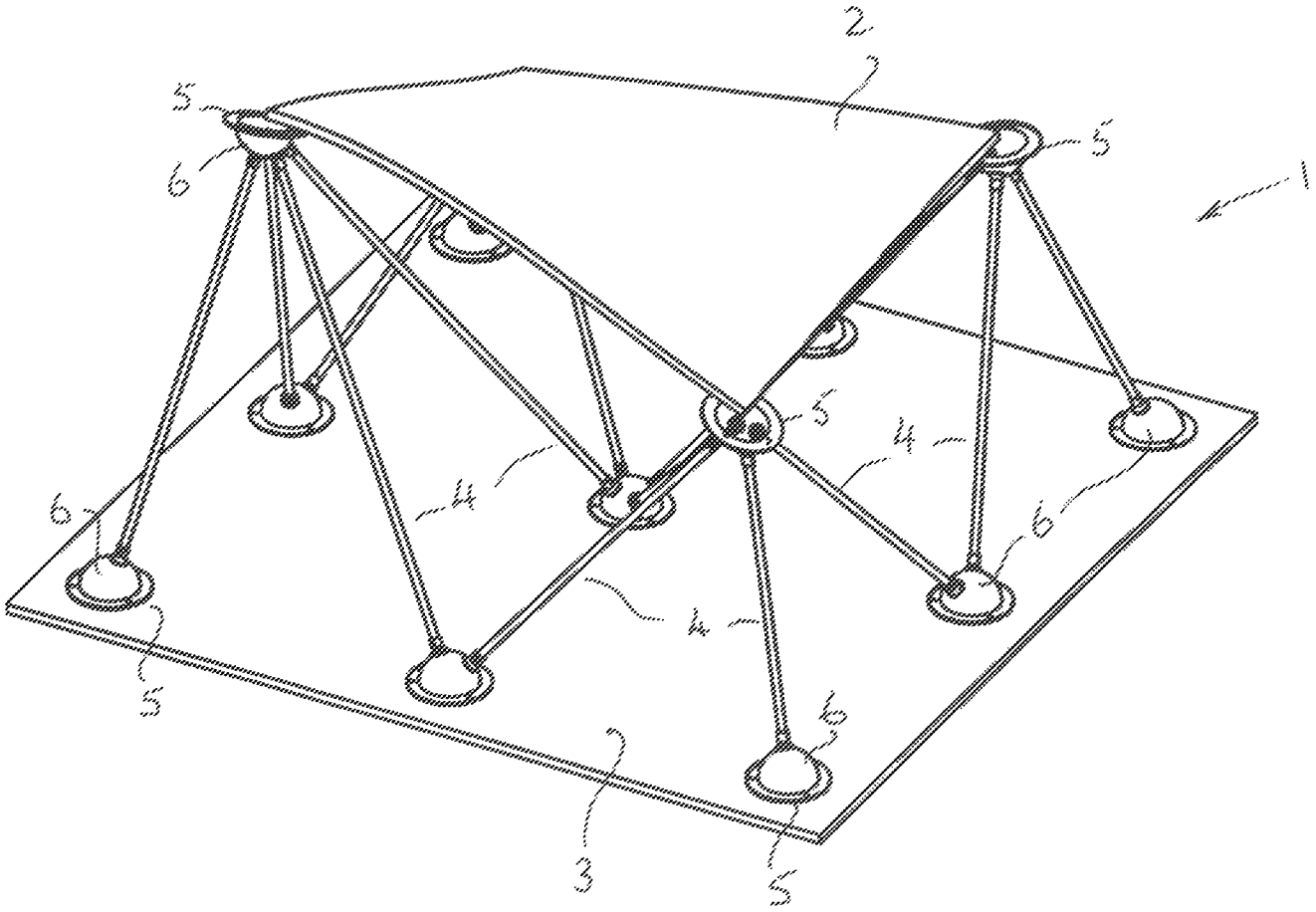
FIG. 1 is illustrative of part of a support-framework according to the invention.

Referring to FIG. 1, the example of support-framework 1 in this case is for the support of a curved surface 2 at a designed varying-spacing above a flat surface 3. In this regard, the support of the curved surface 2 is achieved using elongate supports 4 (each determined individually to be a tie or a strut in dependence upon stress analysis of forces within the framework 1) anchored at one end to the surface 2 and at the other end to the surface 3. The number and relative spacings of the anchoring locations on the two surfaces 2 and 3, and the number and angle of the support members 4 anchored there, are determined using known design processes in dependence upon such factors as the relative dispositions, loadings and individual configurations of the two surfaces 2 and 3. Each anchoring location on the surfaces 2 and 3 constitutes a node N of the framework 1, and according to the present invention each node N involves a hollow domed-member 5 having a hemispherical surface 6 centred on the anchoring location.

A typical domed-member 5 is illustrated by FIGS. 2 to 5 and will now be described.

Referring to FIGS. 2 to 5, the domed-member 5 has an outwardly-directed equatorial flange 7 to the hemispherical surface 6 (the bottom surface of the flange 7 is in the equatorial plane). The surface 6 is pierced radially with an aperture 8 and the flange 7 has fixing holes 9 for use in securing the member 5 to the relevant surface 2 or 3. A notch 10 in the edge of the flange 7 is used for guidance in orienting the dome member 5 appropriately in its installation in the framework 1.

Figure 6:
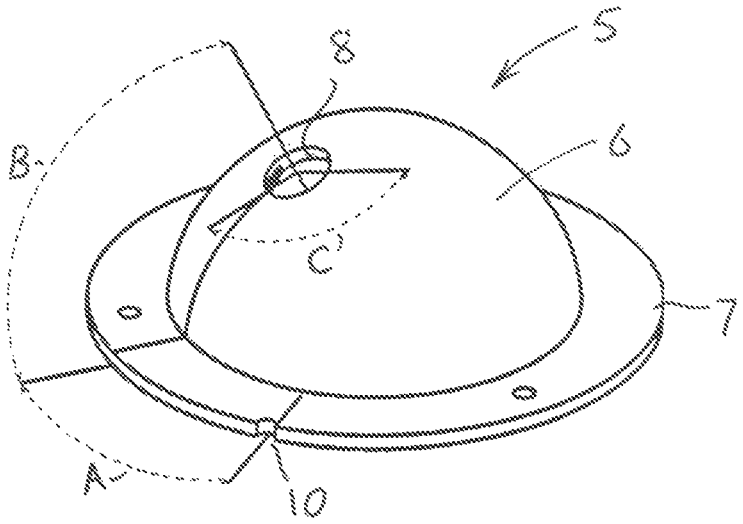
FIG. 6 shows a typical domed-member with illustration of angles used in the location and orientation of a typical aperture in its hemispherical surface.

More particularly, a centre-section plane through the notch 10 and the centre 11 of the hemispherical surface 6 defines a datum plane with reference to which the location and orientation of the aperture 8 can be uniquely defined in terms of an ordered combination of three angles, namely, and as illustrated in FIG. 6: an angle A by which a plane containing the longitudinal axis of the radial aperture 8 and the centre 11 of the surface 6 is angularly spaced 'in azimuth' from the datum plane; an angle B by which the axis of the aperture 8 is angularly spaced 'in altitude' from the base of the flange 7 (the equatorial plane of the surface 6); and an angle C by which the longitudinal axis of the aperture 8 is spaced 'in rotation' out of the plane containing the 'altitude' angle B.

Where more than one elongate support 4 is required to be anchored via a common domed-member 5, the hemispherical surface 6 of that member 5 will be pierced radially by that number of apertures 8, each defined by its unique combination of angles ABC. As with domed-members 5 that anchor a single elongate support 4, the anchoring is effected in each aperture 8 by means of a coupling 12 clamped in the aperture 8 so as to anchor the support 4 securely by its end to the surface 6 of the domed-member 5.

Figure 7:
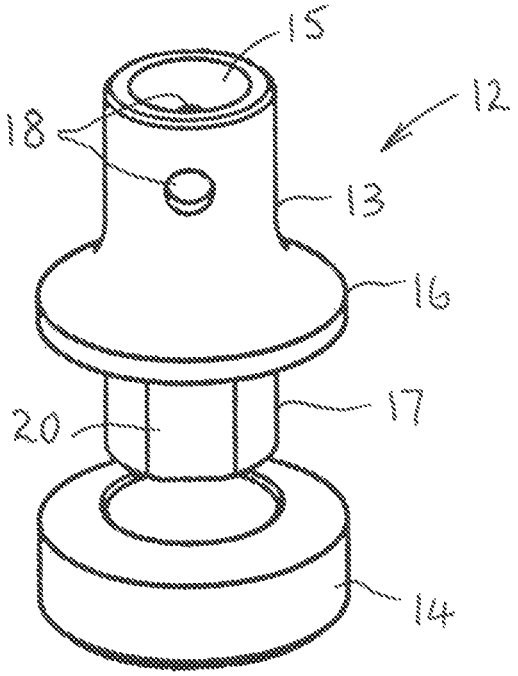
FIG. 7 is an exploded isometric view to an enlarged scale of a typical coupling used for anchoring elongate supports via domed-members of the support-framework of the invention.

A typical coupling 12 is illustrated in FIG. 7, and will now be described.

Referring to FIG. 7, the coupling 12 has two parts, namely a one-piece socket head 13 and a nut 14 for clamping the head 13 to the relevant domed-member 5. In this respect, the head 13 has a hollow, cylindrically-walled socket 15 which is upstanding from a circumferential flange 16, and a threaded spigot 17 (thread not shown) that extends rearwardly from the flange 16. A hole 18 for a rivet extends diametrically through the cylindrical wall of the socket 15, and the threaded spigot 17 has a flat 20 machined into its thread, front and back.

Figure 2:
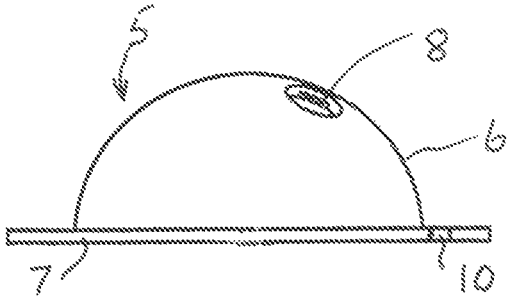
FIGS. 2 to 5 are respectively, a side elevation, an isometric view from above, a sectional view, and a plan view of a typical domed-member of the support-framework of the invention.
Figure 3:
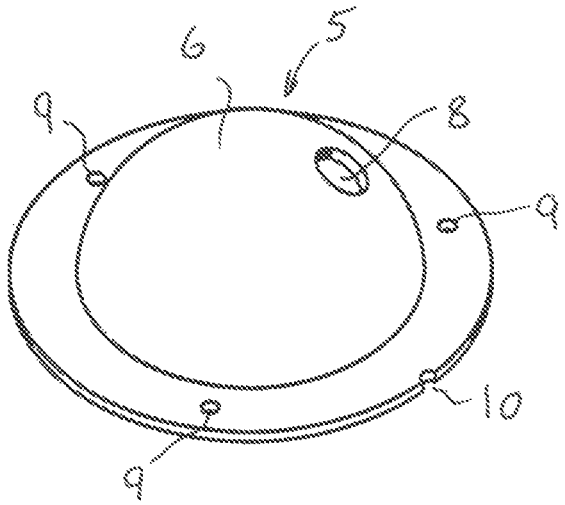
Figure 4:
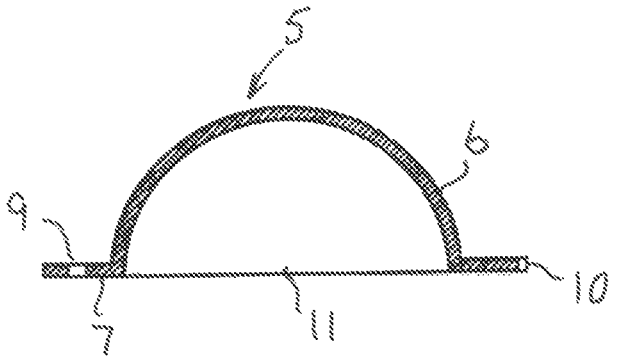
Figure 5:
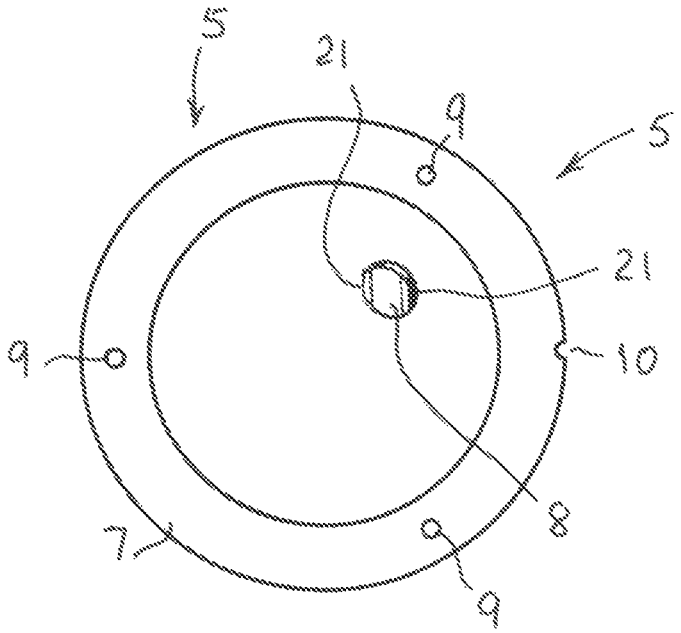

During clamping of the coupling 12 to its domed-member 5, the spigot 17 can be entered fully through the aperture 8 only when it is rotated about its longitudinal axis to align its front and back flats 20 with corresponding, diametrically-opposite flats 21 within the aperture 8 (see FIG. 5; the flats 21 are omitted from the representations of aperture 8 in FIGS. 2 to 4). This enables the nut 14 to be tightened on the spigot 17 within the member 5 so as to clamp the coupling 12 firmly to the surface 6 between the nut 14 and the flange 16 of the head 13. The coupling 12 is by this firmly secured to the domed-member 5 axially-aligned with the axis of the radial aperture 8 to afford increased overall stiffness to the anchoring provided by the domed-member 5.

Figure 8:
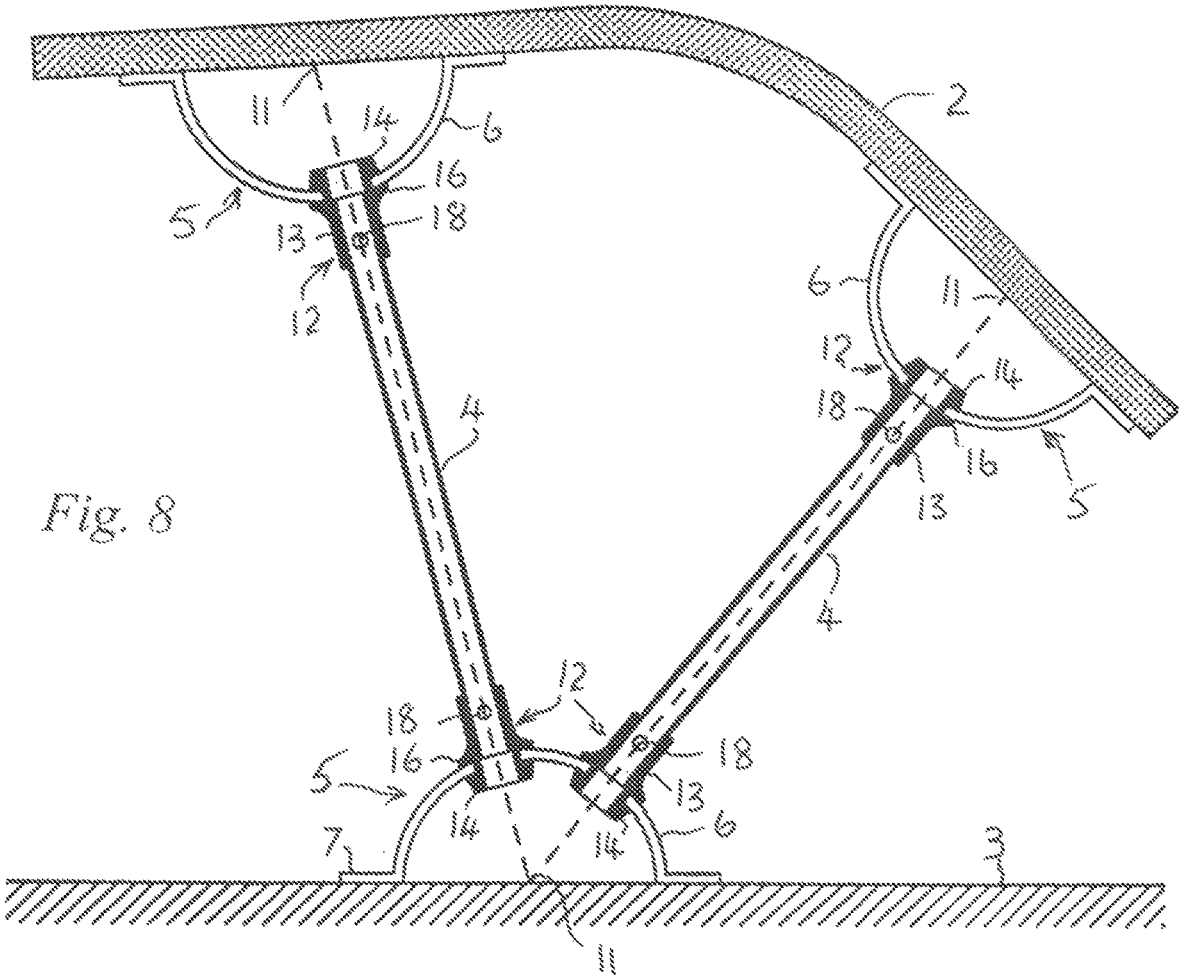
FIG. 8 is illustrative of typical elongate tubular supports each anchored at its two ends by couplings of the form shown in FIG. 7 to domed-members of supporting and supported surfaces respectively, of an installation according to the invention.

FIG. 8 shows part of the framework 1 with two elongate tubular supports 4 (which may each be tubes of extruded aluminium) both anchored at their opposite ends to domed-members 5 secured respectively to the supported surface 2 and the supporting surface 3; the two tubular supports 4 are anchored to the supported surface 2 via separate domed-members 5 and to the supporting surface 3 in common via a single domed-member 5.

A coupling 12 is clamped between its flange 13 and nut 14 to the surface 6 of each domed-member 5 at each end of each tubular support 4. The two ends of each tubular support 4 are inserted (with close fit) in the sockets 15 of the two couplings 12 and are held fast in each coupling 12 by a rivet (not shown) driven through the hole 18 of its socket 15.

The clamping of the coupling 12 in the radial aperture 8 of the hemispherical surface 6 of the domed-member 5 at each end of each tubular support 4, retains the longitudinal axes of the two tubular supports 4 aligned with the centres 11 of the surfaces 6 of the respective domed-members 5 on the two surfaces 2 and 3. Other couplings 12 may be correspondingly added for other individual tubular supports 4 of the framework 1.

Figure 9:
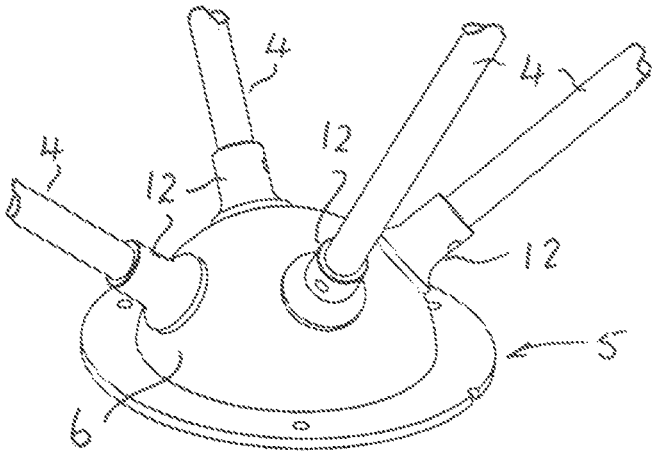
FIG. 9 is an isometric view of a typical domed-member that provides anchoring for four elongate tubular supports.

Although the surface 3 is shown in FIGS. 1 and 9 as straight, flat and continuous, this, and the surface 2 may instead be of curved, interrupted or irregular configuration, and depending on variations in circumstances of stressing and design from one node to another within the framework 1, the domed-members 5 used on each surface 2 and 3 may variously anchor just one supporting member 4, or a plurality of them in common, to that surface.

The domed-members 5 are secured to their respective surfaces 2 and 3 with individual orientations and locations that are determined in accordance with computer analysis and calculations appropriate to the stressing and design of the framework 1. The analysis and calculation includes derivation of the coded angle-combination 'ABC' for each individual domed-member 5 to define the location and orientation of the radially-pierced aperture 8 required in its hemispherical surface 6. The orientations of the flats 21 within the aperture 8 are similarly defined.

An example of a further domed-member 5 with couplings 12 for four tubular supports 4 of the framework 1, is illustrated by FIG. 9. The number of nodes required in a support-framework of the present invention, and the number of tubular supports 4 that are required to be interconnected via each individual node, will vary according to the nature and specifics of the application under consideration. Examples of potential applications include: interior- and exterior-wall cladding; support of ceilings and roofs; floor levelling; construction of temporary and permanent buildings and bridges; scaffolding; temporary and permanent barriers, staircases, staging, grandstands and pavilions; and permanent and temporary play and recreational areas and structures.

Although the present invention has been described above more especially in the context of supporting a surface from another surface, it is to be understood that the invention extends to the provision of a support-framework where support is provided individually to separate elements of a structure or body from a supporting structure or body. In this case, each of one or more elongate supports extends radially of the part-spherical surfaces of the domed-members of a pair of nodes, one located on the relevant element and the other on the supporting structure or body. A support-framework of this form may be used for example in the establishment of a sculpture armature or other sculptural structure in which the one or more elements support separate parts of the sculpture.

The invention claimed is:

1. A support-framework for affording structural support, comprising:

a plurality of structural-support nodes;

a plurality of elongate supports each having an end anchored to one of the structural-support nodes; and wherein each structural-support node comprises a domed-member that has a hemispherically-domed surface, a circumferential flange extending outwardly equatorially from the hemispherically-domed surface, and a coupling clamping the end of a respective one of the elongate supports to the hemispherically-domed surface, and the said, respective one of the elongate supports extends radially outwardly from the hemispherically-domed surface.

2. The support-framework according to claim 1, wherein the elongate supports are each tubular.

3. The support-framework according to claim 1, wherein the elongate supports are rods.

4. The support-framework according to claim 1, wherein the elongate supports are manufactured from metal.

5. The support-framework according to claim 4, wherein the elongate supports are manufactured from extruded tubular metal.

6. The support-framework according to claim 4, wherein at least one of the elongate supports is manufactured from aluminum.

7. A structure comprising a structural-support, a supported surface, and a support-framework located between the structural-support and the supported-surface, the support-framework comprising:

a plurality of first nodes being spaced from one another and secured to the structural-support;

a plurality of second nodes being spaced from one another and secured to the supported-surface;

a plurality of elongate supports having respective first-ends and respect second-ends, the respective first-ends being anchored to the structural-support via a respective one of the plurality of first nodes, and the respective second-ends being anchored to the supported-surface via a respective one of the plurality of the second nodes, the anchoring of the first-ends and the second-ends of the elongate supports via the first and second nodes respectively is via a domed-member individual to the respective node, and wherein each domed-member comprises a hemispherical surface having at least one of the elongate supports extending radially therefrom.

8. The structure according to claim 7, wherein each domed-member comprises a hemispherical surface having an outwardly-directed equatorial flange-part for fixing the domed-member to the respective one of the structural-support and supported-surface.

9. The structure according to claim 8, wherein each domed-member is hollow.

10. The structure according to claim 8, wherein the hemispherical surface is manufactured from plastics.

11. The structure according to claim 8, wherein the hemispherical surface is manufactured from metal.

12. The structure according to claim 8, wherein the first-end and the second-end of each elongate support are anchored respectively to the hemispherical surfaces of respective ones of the first and second nodes via respective first and second couplings, and each coupling comprises a cylindrical socket for receiving an individual one of the first and second ends of the elongate supports, the cylindrical socket being upstanding from a circumferential flange, a threaded spigot extending rearwardly of the socket from the circumferential flange through the hemispherical surface, and a nut engaged with the threaded spigot clamping the coupling to the hemispherical surface between the nut and the circumferential flange.

13. A structure comprising first and second surfaces spaced from one another and a structural support-framework located between the first and the second surfaces, the structure further comprising a plurality of first nodes secured to the first surface, a plurality of second nodes secured to the second surface, a plurality of elongate supports each of which has two opposite ends anchored to a first node and a second nodes respectively;

wherein the anchoring of the first and second ends of each of the elongate supports to the respective first and second nodes is via a hemispherically-domed member individual to the node, and the hemispherically-domed member comprises a hemispherical surface having a center of curvature, and the anchoring of the first and the second ends of each of the elongate supports retains the elongate support clamped fast in length and angularly in longitudinally-radial alignment with the center of curvature of the hemispherical surface of the domed member.

14. The structure according to claim 13, wherein the elongate supports are tubular.

15. The structure according to claim 13, wherein the elongate supports are rods.

16. The structure according to claim 13, wherein each hemispherically-domed member comprises a hemispherical surface having an outwardly-directed equatorial flange to its hemispherical surface.

17. The structure according to claim 13, wherein each hemispherically-domed member is hollow.

18. The structure according to claim 13, wherein a plurality of the hemispherically-domed members are secured at spaced locations from one another to each of the two surfaces.

19. The structure according to claim 13, wherein a plurality of the elongate supports are anchored to more than one of the nodes.

20. The structure according to claim 13, wherein a plurality of the elongate supports are attached to the hemispherical surface of each of one or more of the hemispherically-domed members to be retained clamped fast in length and angularly in longitudinal alignment with the center of the hemispherical surface of the respective domed member.

* * * * *